US005983683A

United States Patent [19]

Shen

[11] Patent Number: 5,983,683

[45] Date of Patent: Nov. 16, 1999

[54] ADAPTER DEVICE FOR A KEY-IN-LEVER TYPE LOCK

[76] Inventor: Mu-Lin Shen, No. 32, La. 76, Sec. 5, Fu-An Rd., Tainan, Taiwan

[21] Appl. No.: 09/020,288

[22] Filed: Feb. 6, 1998

[51] Int. Cl.[6] ..... E05B 13/10; E05B 15/02

[52] U.S. Cl. ..... 70/224; 70/370; 70/449; 70/451; 292/356

[58] Field of Search ..... 70/224, 448, 449, 70/215, 216, 370, 371, 451, 466; 292/356, 357

[56] References Cited

U.S. PATENT DOCUMENTS

| | | | |
|---|---|---|---|
| 798,209 | 8/1905 | Phelps | 70/224 |
| 2,642,302 | 6/1953 | Young | 292/357 |
| 4,428,212 | 1/1984 | Best et al. | 70/224 |
| 5,150,592 | 9/1992 | Lin | 70/224 X |
| 5,177,987 | 1/1993 | Shen | 70/224 |
| 5,409,278 | 4/1995 | Harcourt | 292/357 |
| 5,441,318 | 8/1995 | Ghostley | 292/356 X |
| 5,490,700 | 2/1996 | Zuckerman | 292/357 |
| 5,556,144 | 9/1996 | Lin | 70/224 X |
| 5,617,749 | 4/1997 | Park | 70/224 |
| 5,666,833 | 9/1997 | Gao et al. | 70/224 |
| 5,713,231 | 2/1998 | Shen | 70/449 X |
| 5,732,578 | 3/1998 | Kang | 70/224 |

*Primary Examiner*—Lloyd A. Gall
*Attorney, Agent, or Firm*—William E. Pelton, Esq.

[57] ABSTRACT

An adapter device for a key-in-lever type lock having at least a mounting plate and an escutcheon includes a disk having a central hole defined therethrough so as to receive screw posts, and a split spindle extending from the mounting plate, the disk having a flange extending laterally from a periphery thereof so as to be engaged with a skirt portion of the escutcheon. The disk further has at least one slot and two holes respectively defined therethrough. Two mounting studs each have a threaded protrusion so as to respectively extend through the two holes and to be fixedly connected to the mounting plate.

2 Claims, 5 Drawing Sheets

ADAPTER DEVICE FOR A KEY-IN-LEVER TYPE LOCK

BACKGROUND OF THE INVENTION

1. Field of the Invention

The present invention relates to an adapter device used in a key-in-lever type lock and, more particularly, to the adapter device engaged with an escutcheon with the mounting plate being disposed between the escutcheon and the adapter device so that the escutcheon and the adapter device can be changed in size according to needs while a size of the mounting plate is maintained changed.

2. Brief Description of the Prior Art

A key-in-lever type door lock is shown in FIG. 1 and generally includes a mounting plate 82 through which a spindle 83 and a split spindle 85 are co-axially extended and two screw posts 84 extend therefrom for being connected to one of two escutcheons 81 (only one is shown) and at least one lever 86 having one of two ends thereof connected to the spindle 83 via the escutcheon 81. The split spindle 85 actuates a latch bolt assembly means (not shown) transversely disposed to the mounting plate 82 so that when rotating the lever 86, the latch bolt assembly means which is received in a door (not shown) is operated. A configuration of shape of the escutcheons 81 in such a structure of the key-in-lever type lock is limited because the mounting plate 82 is designed to be received in an space enclosed by a skirt portion 810 of the escutcheon 81 so that if the escutcheon 81 is changed to have another shape, the mounting plate 82 is also changed. However, the mounting plate 82 requires a precise manufacturing standard because it is cooperated with spindle 83 and the split spindle 85 which is cooperated with the latch bolt assembly means. Accordingly, the manufacturing cost and stocking cost will be unnecessarily high if various types of mounting plates are required.

The present invention intends to provide an adapter device to cooperate with the escutcheon so as to dispose the mounting plate therebetween which does not need to be changed in size.

SUMMARY OF THE INVENTION

The present invention provides an adapter device for a key-in-lever type lock which includes a mounting plate through which a spindle and a split spindle co-axially extend so as to operate a latch bolt assembly means, two screw posts extending from the mounting plate, at least one escutcheon mounting to the mounting plate and having a skirt portion extending laterally from a periphery thereof, and a lever extending from the escutcheon and cooperating with the spindle.

The adapter device comprises a disk having a central hole defined therethrough so as to allow the screw posts and the split spindle to extend therethrough. The disk has a flange extending laterally from a periphery thereof so as to be engaged with an inner periphery of the skirt portion of the escutcheon, and at least one slot and two holes respectively defined therethrough. Two mounting studs each have a threaded protrusion and respectively extend through the two holes and are fixedly connected to the mounting plate.

It is an object of the present invention to provide an adapter device which is fixedly connected to the mounting plate and engaged with the escutcheon.

It is another object of the present invention to provide an adapter device which allows a shape of the escutcheon to be changed without changing a structure of the mounting plate.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
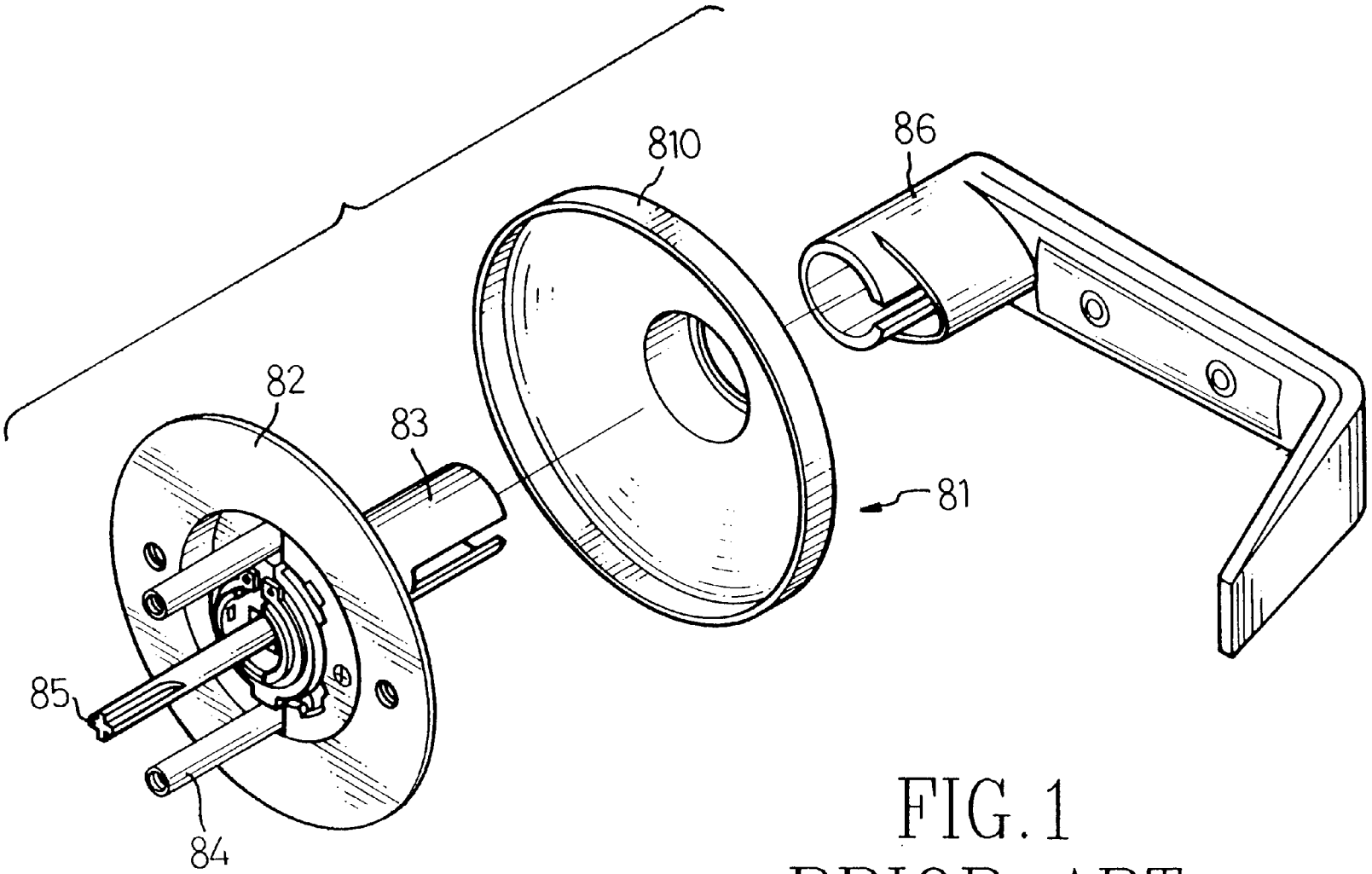
FIG. 1 PRIOR ART
FIG. 1 is an exploded view of a part of a conventional key-in-type lock.
Figure 2:
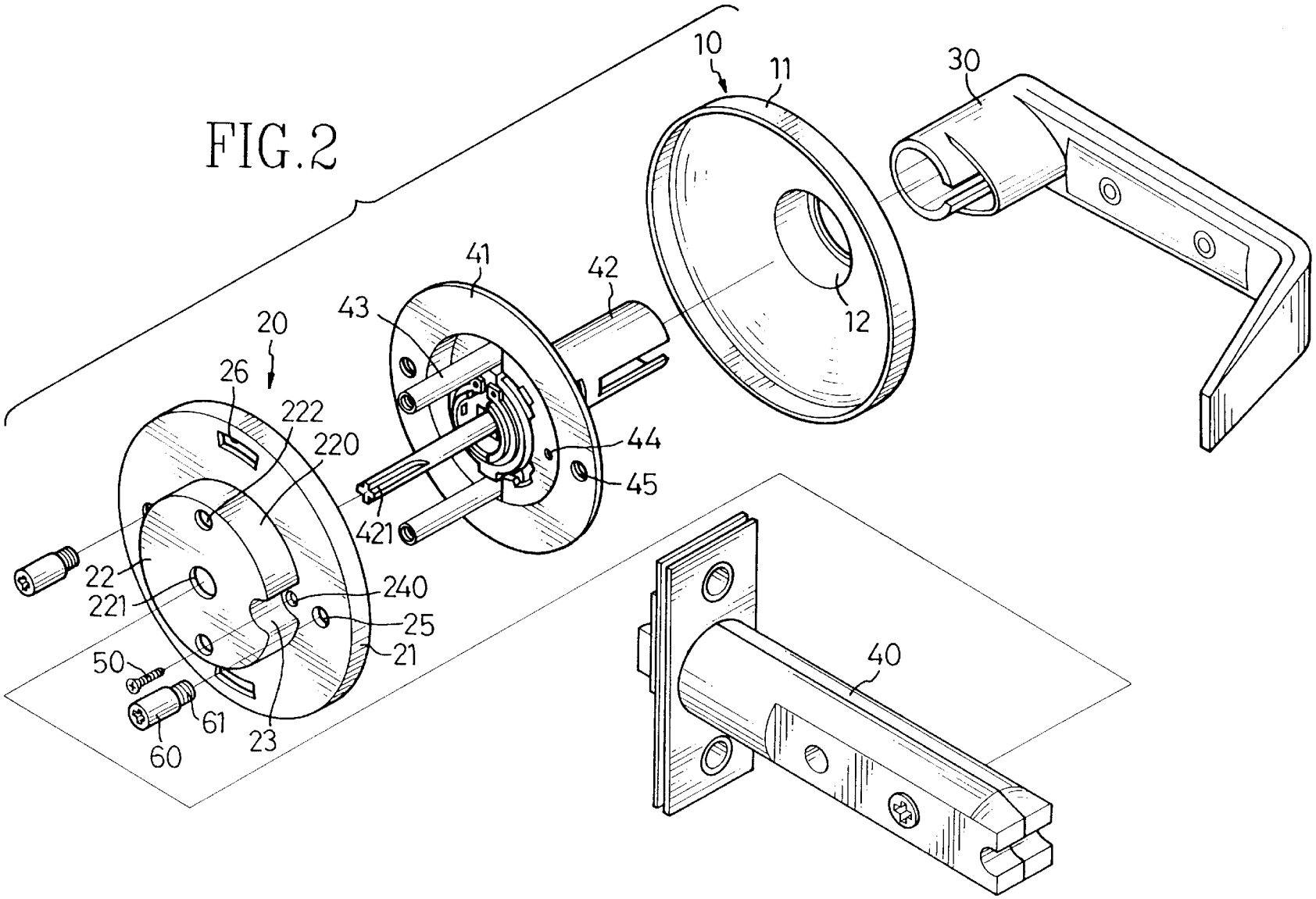
FIG. 2 is an exploded view of a part of a key-in-type lock having an adapter device in accordance with the present invention disposed therein.
Figure 3:
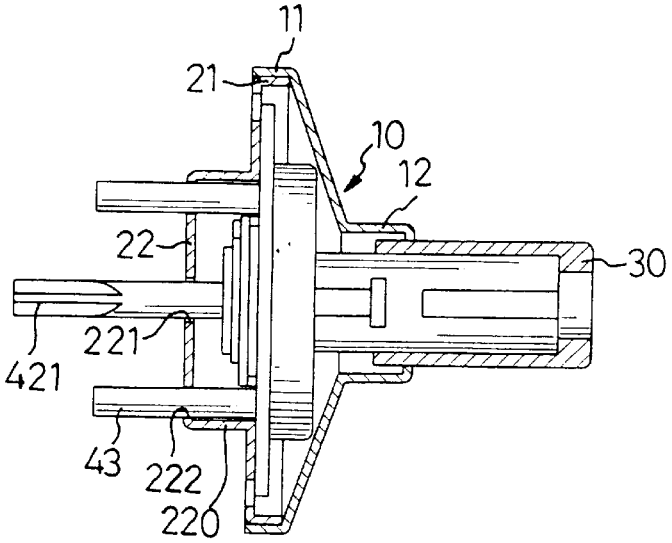
FIG. 3 is a side elevational view, partly in section, of the adapter device of the present invention and the key-in-lever type lock.
Figure 4:
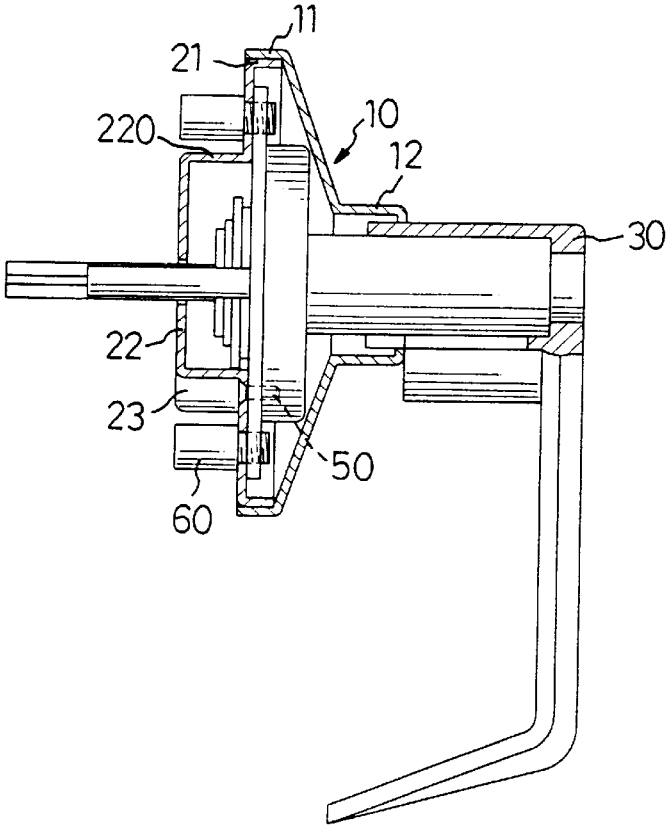
FIG. 4 is a view similar to FIG. 3 but seen from another angle.

Referring to the drawings and initially to FIGS. 2 through 4, a key-in-lever type lock includes a mounting plate 41 through which a spindle 42 and a split spindle 421 co-axially extend in two opposite directions, wherein the split spindle 421 extends into a latch bolt assembly means 40 so as to operate the latch bolt assembly means 40. Two screw posts 43 extend from the mounting plate 41 in a direction opposite to that of the spindle 42. The mounting plate 41 further has two first threaded holes 45 and a second threaded hole 44 respectively defined therethrough. At least one escutcheon 10 has a skirt portion 11 extending laterally from a periphery thereof so that the mounting plate 41 is received in the escutcheon 10. A lever 30 has one of two ends thereof extending into a tubular portion 12 formed in a central part of the escutcheon 10 and engaged with the spindle 42 so that when the lever 30 is rotated, the split spindle 421 accordingly rotates to operate the latch bolt assembly means 40.

The adapter device comprises a disk 20 having a recess defined centrally therein by a peripheral wall 220 and a bottom 22. A central hole 221 and two first holes 222 are respectively defined through the bottom 22 so that the split spindle 421 and the two screw posts 43 respectively extend therethrough. The disk 20 has a flange 21 extending laterally from a periphery thereof so as to be engaged with an inner periphery of the skirt portion 11 of the escutcheon 10. The peripheral wall 220 has defined therein a notch 23. An orifice 240 defined through the disk 20 communicates with the notch 23 so that a screw 50 extends through notch 23 and the orifice 240 and is threadedly received in the second threaded hole 44 to connect the disk 20 to the mounting plate 41. The disk 20 further has two slots 26 and two second holes 25 respectively defined therethrough.

Two mounting studs 60 each have a threaded protrusion 61 and respectively extend through the two second holes 25 and are threadedly received in the first threaded holes 45 by the respective threaded protrusions 61. Accordingly, the mounting plate 41 is connected to the disk 20 which is received within a space enclosed by the skirt portion 11 of the escutcheon 10 so that the escutcheon 10 and the disk 20 can be changed in desired shapes, dimensions and/or sizes without changing the structure of the mounting plate 41.

Figure 5:
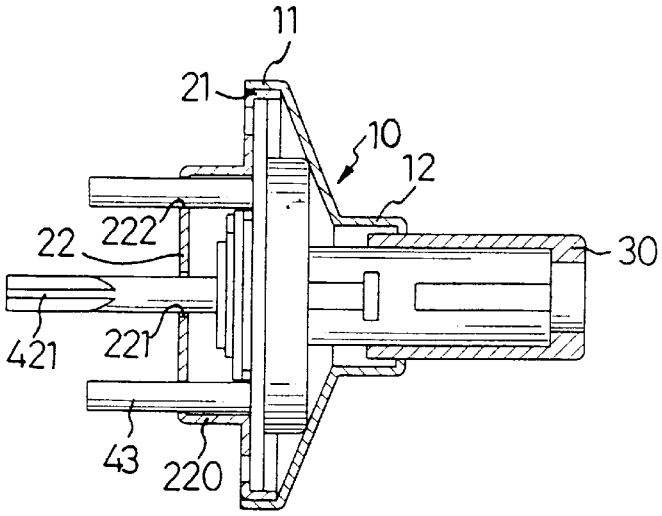
FIG. 5 is a side elevational view, partly in section, of a smaller adapter device of the present invention and the key-in-lever type lock.
Figure 6:
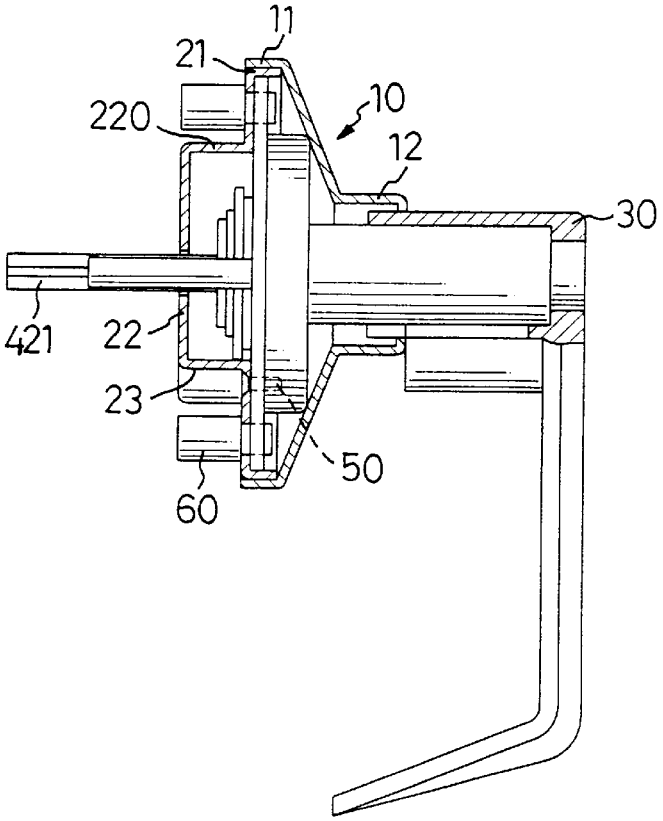
FIG. 6 is a view similar to FIG. 3 but seen from another angle.

FIGS. 5 and 6 respectively show a smaller escutcheon 10, and the adapter device cooperating with the mounting plate 41 is the same as that shown in FIGS. 3 and 4. Manufacturers may manufacture pairs of escutcheons 10 and the adapter device in different shapes and sizes so as to meet customers' needs while maintaining the mounting plates 41 unchanged.

Figure 7:
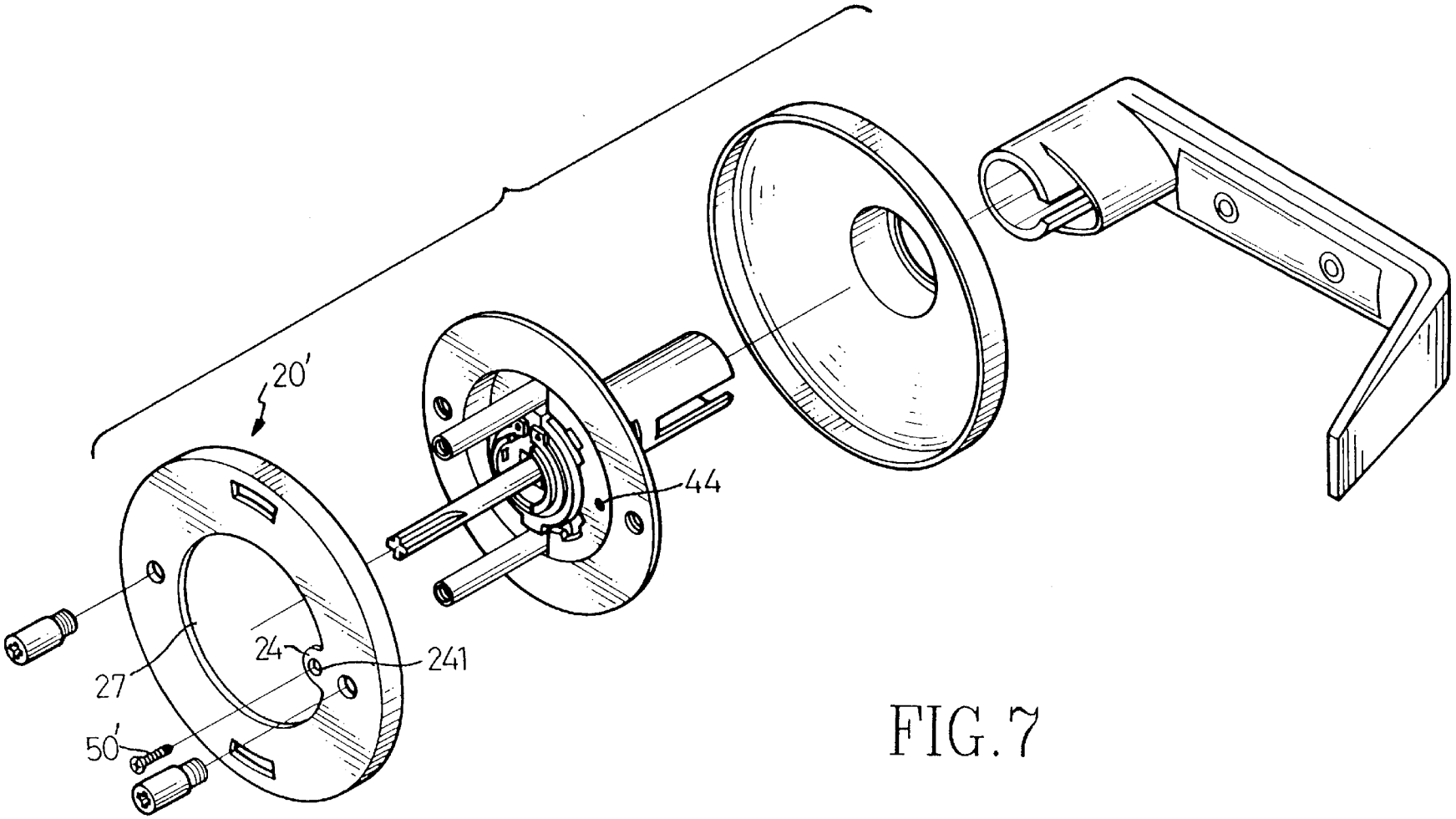
FIG. 7 is an exploded view of a part of a key-in-type lock having another embodiment of the adapter device in accordance with the present invention disposed therein.

FIG. 7 shows another embodiment of the present invention, wherein a disk 20' has a central hole 27 defined therethrough so as to let the screw posts 43 and the split spindle 421 extend therethrough. A lug 24 extends radially inwardly from a periphery defining the central hole 27 and has an aperture 241 defined therethrough so that a screw 50' extending through the aperture 241 is threadedly received in the second threaded hole 44 of the mounting plate 41.

The present invention allows the key-in-lever type lock to have different shapes of escutcheons which are easily manufactured at a low cost so as to meet customers requirements.

Although the invention has been explained in relation to its preferred embodiment, it is to be understood that many other possible modifications and variations can be made without departing from the spirit and scope of the invention as hereinafter claimed.

What is claimed is:

1. An adapter device for a key-in-lever type lock which includes a mounting plate from which a spindle and a split spindle co-axially extend so as to operate a latch bolt assembly means, two screw posts extending from said mounting plate, at least one escutcheon mounting to said mounting plate and having a skirt portion extending laterally from a periphery thereof, and a lever extending from said escutcheon and cooperating with said spindle, said adapter device comprising:

a disk having a recess defined centrally therein by a peripheral wall and a bottom, a central hole and two first holes respectively defined through said bottom so as to be adapted to receive said split spindle and said screw posts therethrough, said disk having a flange extending laterally from a periphery thereof so as to be adapted to be engaged with an inner periphery of said skirt portion of said escutcheon, at least one slot and two second holes respectively defined through said disk, and two mounting studs each having a threaded protrusion and respectively extending through said two second holes and being adapted to be fixedly connected to said mounting plate.

2. The adapter device as claimed in claim 1 wherein said peripheral wall has a notch defined therein, an orifice is defined through said disk and communicates with said notch.

* * * * *